US008657117B2

(12) United States Patent
Musico

(10) Patent No.: US 8,657,117 B2
(45) Date of Patent: Feb. 25, 2014

(54) SCENARIO KIT

(76) Inventor: Nathalie Musico, Elkridge, MD (US)

( * ) Notice: Subject to any disclaimer, the term of this patent is extended or adjusted under 35 U.S.C. 154(b) by 81 days.

(21) Appl. No.: 13/532,007

(22) Filed: Jun. 25, 2012

(65) Prior Publication Data

US 2013/0341215 A1 Dec. 26, 2013

(51) Int. Cl.

| | |
|---|---|
| ***B65D 71/00*** | (2006.01) |
| ***B65D 69/00*** | (2006.01) |
| ***B65D 85/00*** | (2006.01) |
| ***G09B 25/00*** | (2006.01) |
| ***A63H 33/04*** | (2006.01) |

(52) U.S. Cl.
USPC ..... 206/575; 206/232; 206/459.5; 206/579; 434/429; 446/75

(58) Field of Classification Search
USPC ..... 206/216, 223, 232, 457, 459.1, 459.5, 206/575, 579; 434/81, 403, 429; 446/75, 76
See application file for complete search history.

(56) References Cited

U.S. PATENT DOCUMENTS

| | | | | |
|---|---|---|---|---|
| 2,972,821 A * | 2/1961 | Bond | ..... | 434/429 |
| 5,522,507 A * | 6/1996 | Cruz | ..... | 206/575 |
| 5,934,551 A * | 8/1999 | Kaufman | ..... | 206/232 |
| 7,597,198 B1 * | 10/2009 | Foster | ..... | 206/575 |

* cited by examiner

*Primary Examiner* — Bryon Gehman
(74) *Attorney, Agent, or Firm* — James A. Italia; Italia IP

(57) ABSTRACT

A novelty kit comprising components which represent elements for coping with and surviving attempts by another person to dispose of the user of the kit according to any one of several disposal scenarios. The scenarios may include inducing an apparently accidental fall, inducing drowning, and being buried alive. The elements of the kit would be thematically linked to warding off a fall, to resist drowning, and to cope with being buried alive. The kit may take the form of a receptacle containing pill bottles bearing labels reciting the contents and including humorous instructions for use and humorous or appropriate hazard warnings.

17 Claims, 1 Drawing Sheet

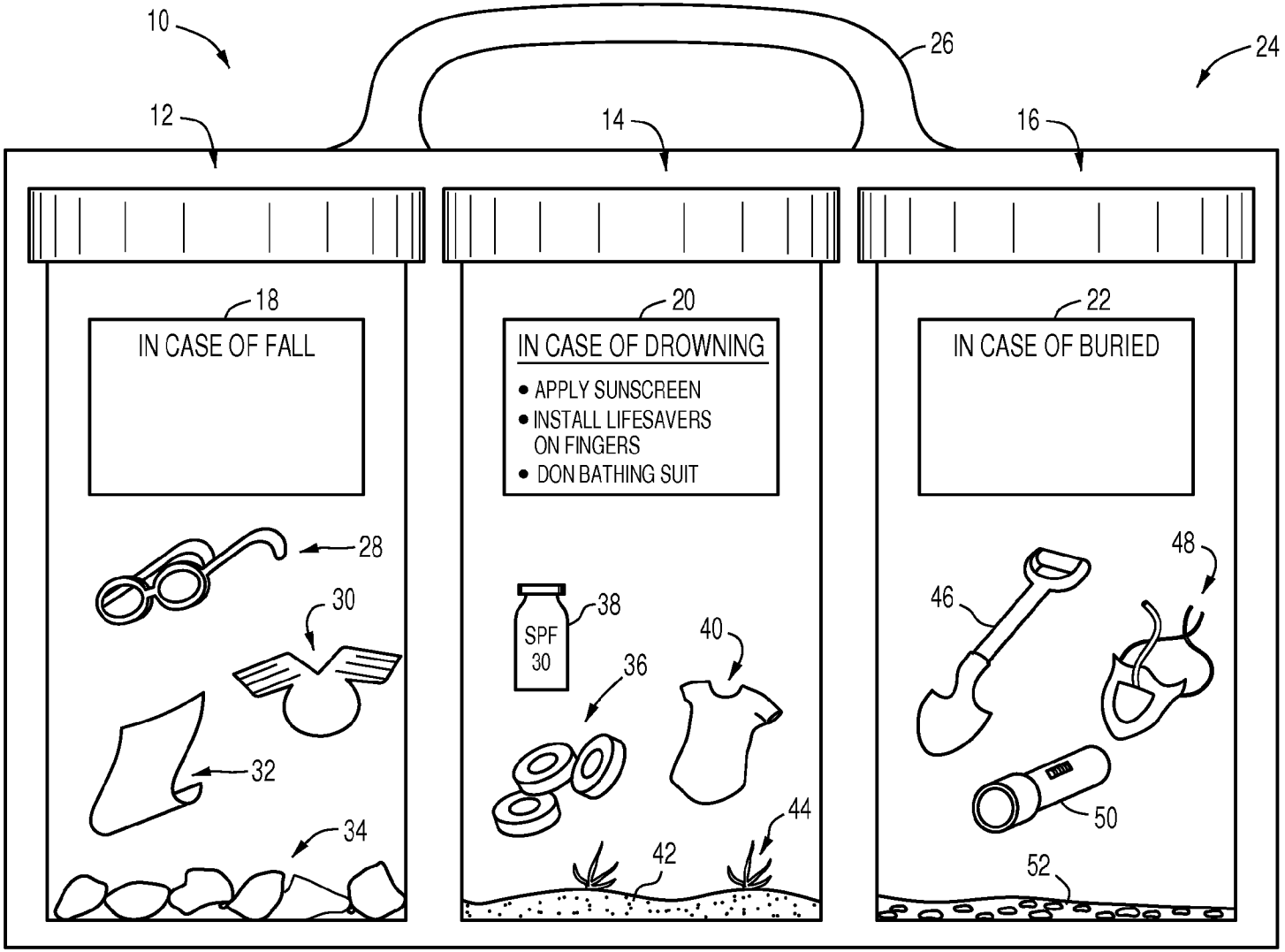
IN CASE OF FALL
IN CASE OF DROWNING
• APPLY SUNSCREEN
• INSTALL LIFESAVERS ON FINGERS
• DON BATHING SUIT
SPF 30
IN CASE OF BURIED
10
12
14
16
18
20
22
24
26
28
30
32
34
36
38
40
42
44
46
48
50
52

SCENARIO KIT

FIELD OF THE INVENTION

The present invention relates to a novelty which presents hypothetical physical supplies which would be humorously appropriate in certain situations in which it is desired to do away with one's spouse.

BACKGROUND OF THE INVENTION

Situations pertaining to people's lives have inspired a number of humorously intended novelty devices. One such device takes the place of a hypothetical kit which typically includes props, or objects intended to represent symbolically emotions and attitudes. A kit may humorously present objects which may be used in resolution of conflict which invariably arises in human relationships.

SUMMARY OF THE INVENTION

The present invention addresses a form of conflict in which an exaggerated or apocryphal action is representatively to be taken, notably, that of disposing of a spouse. To this end, the present invention contemplates a novelty or gag kit having symbolic apparatus for compensating for hypothetical scenarios or procedures in which a person such as a spouse is disposed by the other spouse. The kit generates a humorous effect by presenting simulated apparatus which would be appropriate for escapting dispatching of the spouse to be disposed, with dispatching taking any one of several foreseeable scenarios.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawing which is a side view of an exemplary kit in accordance with the present invention.

DETAILED DESCRIPTION

Referring the to Drawing, according to at least one aspect of the invention, there is shown a novelty kit 10 intended for humorously and symbolically coping with a scenario in which one's spouse attempts to dispose of one by utilizing any one of a plurality of disposal scenarios. Any number of scenarios may be provided for, including only one. However, the present example will show three scenarios. It is contemplated that the novel kit 10 will be used as a humorous response to a frequently encountered situation in which a husband, after perhaps twenty years of marriage, will want to leave his long standing spouse in favor of another woman. While disposing of the wife by murder is certainly an extreme reaction to this feeling, the kit humorously assumes that this will indeed be the husband's action, and may humorously propose to provide antidotes to several disposal scenarios presented in the form of prescribable antidotes to the various scenarios. These antidotes may be presented conveniently as pill bottles 12, 14, 16 which may be retrieved for immediate use in the event that a disposal scenario is undertaken, the way a patient would retrieve and use medicaments for combatting ordinary medical conditions. The pill bottles 12, 14, 16 may be complete with humorously appropriate directions which may be imprinted on respective labels 18, 20, 22. The pill bottles 12, 14, 16 may be enclosed within a receptacle 24 which may have a carrying handle 26 for example.

The scenarios for disposing of the wife may include any of several scenarios which have been popularized in books and electronic media as the basis for stories about murder, including for example a first disposal scenario predicated on simulating a fatal fall wherein the spouse being disposed is presumed to be pushed from a great height so as to be killed on impact with an environmental surface.

A second disposal scenario may be predicated on intentional drowning. A third disposal scenario may be predicated on assuming that the husband will bury the wife alive.

The pill bottle 12 may be dedicated to the first disposal scenario described above, namely, a fall. To that end, the pill bottle 12 may contain at least one and preferably a plurality of miniaturized objects which are thematically linked to the first disposal scenario. In keeping with the intended humorous element of the novelty kit 10, the miniaturized objects may symbolically represent light hearted rather than serious efforts to ward off the ill effects of a potentially fatal fall. Illustratively, the miniaturized objects could include aviator goggles 28, an aviator pin or brooch 30 which may for example be of the type typically worn by flight attendants on commercial airlines to identify the wearer as an aviator, and printed lyrics 32 to a song appropriate for the occasion and in keeping with the humorous intent of the kit 10. Illustratively, a selected song could pertain to flying, and more particularly to flying without assistance of aircraft, an example being "I Believe I Could Fly".

The contents of the pill bottle 12 may also include environmental objects associated with falling, such as a bed of stones 34 which are suggestive of the intended hard impact of the induced fall.

The pill bottle 14 may be dedicated to the second disposal scenario, notably intentional drowning. Miniaturized objects contained within the pill bottle 14 may be thematically linked to the drowning scenario by for example pertaining to efforts to swim and to exposure to the elements as might occur if one were abandoned to drown. The miniaturized objects of the pill bottle 14 therefore could include one or more safety floats, for example represented by torroidal objects 36. The torroidal configuration may be regarded as representative because of the long standing tradition of using inflatable vehicle tire inner tubes as floats. Torroidal objects 36 which are sufficiently small as to be usable as miniaturized objects for the second disposal scenario may conveniently take the form of edible candies which are commonly commercially available. Another miniaturized object which is thematically linked to drowning may comprise a container 38 labeled as containing sunscreen lotion. The container 38 may actually contain sunscreen lotion or another protective lotion, or may be only labeled as containing such a lotion. A further miniaturized object which is thematically linked to drowning may comprise swimming apparel 40. The swimming apparel 40 may be made from a material which swells when contacting water, or alternatively, may be depicted or represented as being so even if not actually being made from a material which swells when contacting water.

The pill bottle 14 may comprise miniaturized objects representing the environment of the proposed second scenario, such as sand 42 and aquatic plants 44 representing the bed of a natural body of water.

The pill bottle 16 may be dedicated to a third disposal scenario, notably, that of being buried alive. Again in keeping with the purpose of the contents of the pill bottle bottle 16, miniaturized objects contained therein may pertain to efforts to cope with being buried alive. Therefore, one of the miniaturized objects may comprise a spade shovel 46. A second one of the miniaturized objects may comprise an oxygen mask 48. Another one of the miniaturized objects may comprise a flashlight 50.

The bottom of the pill bottle 16 may be covered with sand 52 or another form of natural ground to represent the environment of the hypothetical burial.

It is also preferred that the novelty kit 10 include first indicia identifying the respective pill bottles 12, 14, 16 as being thematically linked to their respective first scenario, second scenario, and third scenario. This may be accomplished by providing appropriately humorous instructions for using the respective miniaturized objects in a way that is pertinent to their respective disposal scenarios. Such instructions may be imprinted on the labels 18, 20, and 22.

One illustration of instructions will be described in representative capacity. The label 20 may bear indicia including the introduction "In Case of Drowning", and may contain instructions to apply the sunscreen provided in the container 38, to install the torroidal objects 36 as safety floats on the fingers of the user of the novelty kit 10, and to done the swimming apparel 40. Instructions for use may be expanded to include humorous warnings such as warning that reliance upon the sunscreen product ostensibly contained within the container 38 may result in sunburn; that drowning may occur prior to the swimming apparel 40 swelling to appropriate size for a human adult; and that consuming the miniaturized torroidal objects 36 is not recommended for those suffering from diabetes. Obviously, the labels 18 and 22 may be similarly humorously directed to the miniaturized objects of their respective pill bottles 12 and 16.

The novelty kit 10 may take forms other than those specifically presented herein. For example, it is not necessary that the pill bottles 12, 14, 16 be provided, although it is acknowledged that presenting the novelty kit 10 in the form of a medical product may add to the humorous aspects of the novel concept.

Obviously, although description herein contemplates disposal of a wife by a husband, these roles could be reversed, or modified to accommodate other relationships. Contents of the novelty kit 10 could be varied in accommodation of such modification.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A novelty kit for humorously and symbolically coping with a scenario in which a person's spouse attempts to dispose of the person by utilizing any one of a plurality of person disposal scenarios including a first disposal scenario and a second disposal scenario, comprising:

a receptacle;

a first miniaturized object which is thematically linked to the first disposal scenario and which first miniaturized object fits into the receptacle; and a second miniaturized object which is thematically linked to the second disposal scenario and which second miniaturized object fits into the receptacle;

first indicia disposed in the receptacle identifying the first miniaturized object as being thematically linked to the first scenario;

second indicia disposed in the receptacle identifying the second miniaturized object as being thematically linked to the second scenario;

first instructions for using the first miniaturized object in a way that is pertinent to the first scenario; and second instructions for using the second miniaturized object in a way that is pertinent to the second scenario.

2. The novelty kit of claim 1, wherein one of the first scenario and the second scenario comprises inducing the spouse being disposed to fall, and one of the first miniaturized object and the second miniaturized object pertains to efforts to ward off the effects of a fall.

3. The novelty kit of claim 2, wherein one of the first miniaturized object and the second miniaturized object comprises miniaturized aviator goggles.

4. The novelty kit of claim 2, wherein one of the first miniaturized object and the second miniaturized object comprises a miniaturized aviator pin identifying a wearer as an aviator.

5. The novelty kit of claim 2, wherein one of the first miniaturized object and the second miniaturized object comprises printed lyrics to a song pertaining to flying.

6. The novelty kit of claim 1, wherein one of the first scenario and the second scenario comprises inducing the spouse being disposed to drown, and one of the first miniaturized object and the second miniaturized object pertains to efforts to swim.

7. The novelty kit of claim 1, wherein one of the first scenario and the second scenario comprises inducing the spouse being disposed to drown, and one of the first miniaturized object and the second miniaturized object pertains to a safety float.

8. The novelty kit of claim 1, wherein one of the first scenario and the second scenario comprises inducing the spouse being disposed to drown, and one of the first miniaturized object and the second miniaturized object pertains to a container labeled as containing sunscreen lotion.

9. The novelty kit of claim 1, wherein one of the first scenario and the second scenario comprises inducing the spouse being disposed to drown, and one of the first miniaturized object and the second miniaturized object comprises swimming apparel.

10. The novelty kit of claim 1, wherein one of the first scenario and the second scenario comprises inducing the spouse being disposed to drown, and one of the first miniaturized object and the second miniaturized object comprises a torroidal object which simulates a torroidal float.

11. The novelty kit of claim 10, wherein the torroidal objects comprises edible candy.

12. The novelty kit of claim 1, wherein one of the first scenario and the second scenario comprises inducing the spouse being disposed to drown, and one of the first miniaturized object and the second miniaturized object represents the bed of a natural body of water.

13. The novelty kit of claim 1, wherein one of the first scenario and the second scenario comprises inducing the spouse being disposed to be buried alive, and one of the first miniaturized object and the second miniaturized object pertains to efforts to cope with being buried alive.

14. The novelty kit of claim 13, wherein one of the first miniaturized object and the second miniaturized object comprises a miniature shovel.

15. The novelty kit of claim 13, wherein one of the first miniaturized object and the second miniaturized object comprises an oxygen mask.

16. The novelty kit of claim 13, wherein one of the first miniaturized object and the second miniaturized object comprises a flashlight.

17. The novelty kit of claim 1, wherein the plurality of disposal scenarios includes a third disposal scenario;

the novelty kit includes at least a third miniaturized object which is thematically linked to the third scenario;

the novelty kit includes third indicia identifying the third miniaturized object as being thematically linked to the third scenario; and the novelty kit includes third instructions for using the third miniaturized object in a way that is pertinent to the third scenario.

* * * * *